US009078484B2

(12) United States Patent
Hennig

(10) Patent No.: US 9,078,484 B2
(45) Date of Patent: Jul. 14, 2015

(54) SOLE FOR A SHOE AND SHOE

(75) Inventor: Ewald Hennig, Essen (DE)

(73) Assignee: UNIVERSITAET DUISBURG-ESSEN, Essen (DE)

( * ) Notice: Subject to any disclaimer, the term of this patent is extended or adjusted under 35 U.S.C. 154(b) by 356 days.

(21) Appl. No.: 13/635,688

(22) PCT Filed: Mar. 19, 2010

(86) PCT No.: PCT/EP2010/001732

§ 371 (c)(1),
(2), (4) Date: Nov. 20, 2012

(87) PCT Pub. No.: WO2011/113450

PCT Pub. Date: Sep. 22, 2011

(65) Prior Publication Data

US 2013/0055597 A1 Mar. 7, 2013

(51) Int. Cl.

| | |
|---|---|
| ***A43B 13/14*** | (2006.01) |
| ***A43B 7/00*** | (2006.01) |
| ***A43B 13/18*** | (2006.01) |

(52) U.S. Cl.

CPC . *A43B 7/00* (2013.01); *A43B 13/14* (2013.01); *A43B 13/145* (2013.01); *A43B 13/148* (2013.01); *A43B 13/188* (2013.01)

(58) Field of Classification Search

CPC ..... A43B 3/0036; A43B 13/14; A43B 7/14
USPC ..... 36/25 R, 31, 103, 142, 143, 144
See application file for complete search history.

(56) References Cited

U.S. PATENT DOCUMENTS

| | | | | |
|---|---|---|---|---|
| 5,921,009 | A * | 7/1999 | Hice | 36/140 |
| 6,349,487 | B1 * | 2/2002 | Hice | 36/140 |
| 6,578,290 | B1 * | 6/2003 | Meynard | 36/103 |
| 6,782,639 | B1 | 8/2004 | Müller | |
| 7,287,341 | B2 * | 10/2007 | Ellis, III | 36/25 R |
| 7,793,437 | B2 * | 9/2010 | Chapman et al. | 36/88 |
| 8,038,583 | B2 * | 10/2011 | Bailar | 482/79 |
| 8,127,467 | B2 * | 3/2012 | Koyama | 36/25 R |
| 8,387,277 | B2 * | 3/2013 | Andriacchi et al. | 36/25 R |
| 2008/0127515 | A1 | 6/2008 | Lohrer | |

(Continued)

FOREIGN PATENT DOCUMENTS

| | | |
|---|---|---|
| DE | 297 01 013 U1 | 4/1997 |
| DE | 20 2006 016 038 U1 | 1/2007 |

(Continued)

*Primary Examiner* — Marie Bays
(74) *Attorney, Agent, or Firm* — Norman B. Thot

(57) ABSTRACT

A sole for a shoe designed to increase an instability upon striking the ground. The sole extends from a rear heel region via a metatarsal region to a front forefoot region. In a region of a gait line, the sole includes an instability region which substantially follows a contour of the gait line and extends at least in sections in a longitudinal direction of the sole. A bulk modulus is increased compared to at least one of a medial outer region and a lateral outer region of the sole adjacent to the instability region, and/or, a sole thickness is increased compared to at least one of the medial outer region and the lateral outer region of the sole adjacent to the instability region so as to provide an uneven sole contour perpendicular to a running direction.

17 Claims, 3 Drawing Sheets

(56) References Cited

U.S. PATENT DOCUMENTS

| | | | | |
|---|---|---|---|---|
| 2009/0199432 | A1* | 8/2009 | Park | 36/88 |
| 2009/0293307 | A1 | 12/2009 | Koyama | |
| 2011/0138657 | A1* | 6/2011 | Christensen | 36/103 |
| 2013/0055597 | A1* | 3/2013 | Hennig | 36/25 R |
| 2013/0312292 | A1* | 11/2013 | Yudelowitz | 36/25 R |
| 2014/0047740 | A1* | 2/2014 | Tucker et al. | 36/103 |

FOREIGN PATENT DOCUMENTS

| | | | |
|---|---|---|---|
| DE | 10 2009 010 360.0 | | 9/2010 |
| EP | 1 941 808 | A1 | 7/2008 |
| FR | 2 735 334 | A1 | 12/1996 |
| WO | WO 01/15560 | A1 | 2/2001 |
| WO | WO 01/49143 | A1 | 7/2001 |
| WO | WO 2010/136513 | A1 | 12/2010 |

* cited by examiner

SOLE FOR A SHOE AND SHOE

CROSS REFERENCE TO PRIOR APPLICATIONS

This application is a U.S. National Phase application under 35 U.S.C. §371 of International Application No. PCT/EP2010/001732, filed on Mar. 19, 2010. The International Application was published in German on Sep. 22, 2011 as WO 2011/113450 A1 under PCT Article 21(2).

FIELD

The present invention relates to a sole for a shoe designed for increasing the instability upon striking the ground, with the sole, for example, extending from a rear heel region via a metatarsal region to a front forefoot region. Moreover, the present invention relates to a shoe, in particular a training shoe for schooling coordination and for strengthening the muscles, with a sole of the aforementioned type.

BACKGROUND

The prior art has disclosed shoes with a sole shape convexly rounded in the running direction, with an inserted soft heel part. As a result of the thereby deliberately softened shoe-base design of the so-called Masai-Barefoot-Technology (MBT) shoe, the foot loses the hold characterizing a physiological locomotion and the support. This should have an effect on relatively large parts of the hold and support muscles because there now is the need to actively keep the body balanced. As a result of these constantly required minimal compensation movements and strains of the foot muscles while seeking secure standing, wearing MBT shoes should lead to coordination training being carried out on a permanent basis and additional parts of the skeletal muscles being used. Depending on the muscular state of the wearer, simple walking in these shoes should in particular result in a strengthening of the leg, abdominal and back muscles. This should indirectly lead to a decrease in the load on joints. Moreover, by strengthening the muscles near the joints, MBT shoes should have a preventative action against one-sided overloading and tenseness.

Controversy surrounds the alleged health benefits that can be obtained from wearing MBT shoes. Until now, it has not been possible to show a significant improvement in coordination ability as a result of wearing MBT shoes, with wearing the shoes being perceived to be difficult and not very comfortable as a result of the shape of the sole which is convexly rounded in the running direction, and moreover possibly leading to pain during wear. Finally, as a result of the special sole shape, MBT shoes are generally also perceived as not looking very attractive.

SUMMARY

An aspect of the present invention is to provide a sole and a shoe, respectively, of the type mentioned at the outset, which bring about an increased training of the balancing ability, a schooling of the muscle coordination, and muscle strengthening for the wearer of a shoe having such a shoe sole, wherein the aforementioned disadvantages of MBT shoes do not occur.

In an embodiment, the present invention provides a sole for a shoe designed to increase an instability upon striking the ground. The sole extends from a rear heel region via a metatarsal region to a front forefoot region. In a region of a gait line, the sole includes an instability region which substantially follows a contour of the gait line and extends at least in sections in a longitudinal direction of the sole. A bulk modulus is increased compared to at least one of a medial outer region and a lateral outer region of the sole adjacent to the instability region, and/or, a sole thickness is increased compared to at least one of the medial outer region and the lateral outer region of the sole adjacent to the instability region so as to provide an uneven sole contour perpendicular to a running direction.

BRIEF DESCRIPTION OF THE DRAWINGS

The present invention is described in greater detail below on the basis of embodiments and of the drawings in which.

DETAILED DESCRIPTION

Figure 1:
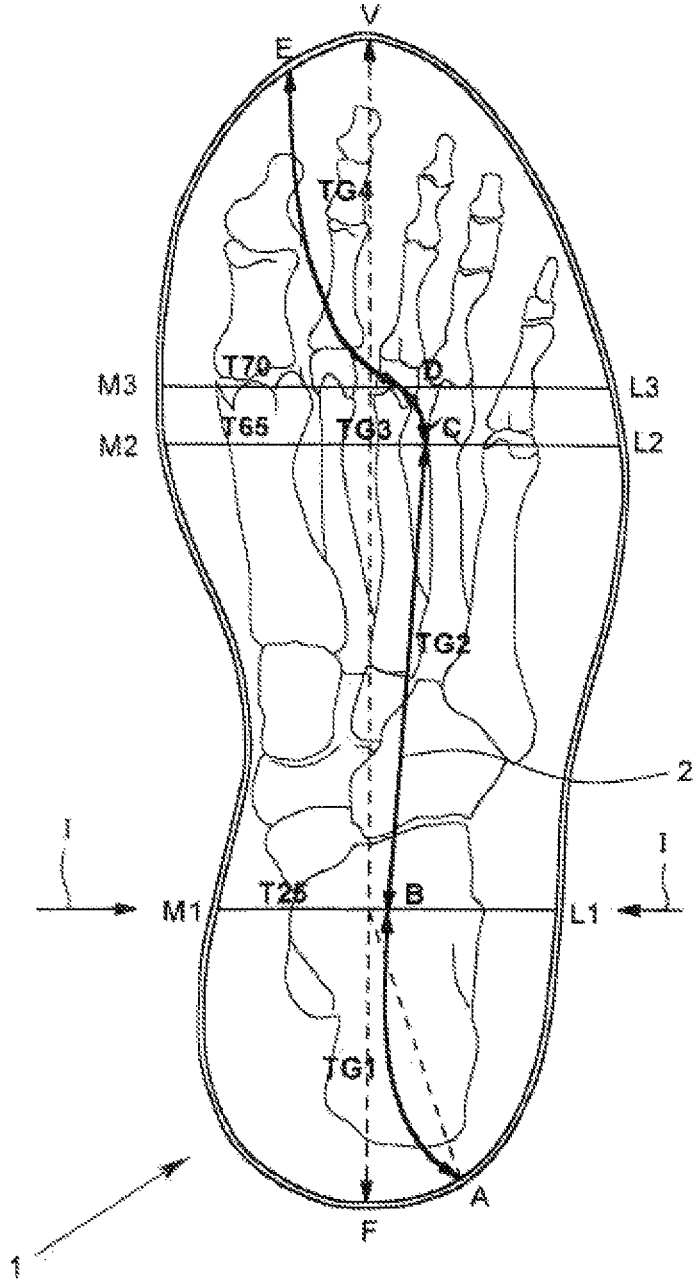
FIG. 1 shows a schematic illustration of a shoe sole, with the profile of the gait line being determined and plotted on the basis of averaged values.

In an embodiment of the present invention, the aforementioned object is achieved by virtue of the fact that, in the region of the gait line, the sole has an instability region which follows the contour of the gait line, at least in sections extends in the longitudinal direction of the sole and has an increased bulk modulus compared to the adjacent medial regions of the sole, facing the center of the body, and/or lateral regions of the sole, facing away from the center of the body. Here, the bulk modulus within the meaning of the present invention is related to the overall bulk modulus of the sole over the sole thickness, wherein the sole can consist both of a substantially homogeneous material with a bulk modulus which remains constant over the sole thickness, for example, a foamed polymer, and of a material that has interspaces, e.g., honeycombs, over the sole thickness such that the bulk modulus changes over the sole thickness. The overall bulk modulus of the sole at a specific point of the sole is respectively established in the vertical direction over the whole thickness of the (outer) sole at this point. As a result of introducing honeycombs or cavities, it is possible to change the overall bulk modulus correspondingly at a specific point of the sole.

The increased bulk modulus leads to the sole offering less resistance to compression in the region outside of the instability region than in the region of the instability region. Here, the bulk modulus describes what one-sided pressure change is required to cause a specific change in volume. At this point, the present invention is based on the underlying concept of constructing the shoe sole to reduce the stability when striking the ground in the case of the normal gait, the sporty running and sprinting, with the increased bulk modulus in the region of the center of pressure line or the gait line during walking, running and physical exercise creating an instability underfoot, said instability leading to motor learning processes. The striking of the ground by the foot and the heel-toe walking with the foot become more unstable and needs to be compensated for in neuromuscular fashion. This contains intrinsic motor learning of diverse patterns for muscle control in the brain and on a spinal level within the meaning of an improved balancing ability. The balancing ability is trained by wearing a shoe with a sole of the above-described type, the muscle coordination is schooled and the muscles are strengthened. In doing so, the shoe with the sole according to the present invention can be used equally in the field of therapy, in sports, and for increased foot comfort.

Protection with the sole according to the present invention is directed at elderly persons for fall prevention, at obese patients lacking balance control, at children with balance disorders as a result of lack of exercise, and at patients with neuropathies, such as Parkinson's patients, who have reduced control of balance. As a comfort shoe, it is possible to prevent a one-sided load on the muscles and hence local overload, which can lead to muscular fatigue and muscular pain. The increased bulk modulus in the instability region of the sole simulates the effect of an uneven ground. As a training shoe, a shoe with the sole according to the present invention can be used for schooling coordination in all areas of sport in which balance and balance control play a particular role. As a result of simulating the effect of an uneven ground, this brings about the strengthening of the muscles by increased use of otherwise neglected muscles. It can here, for example, be the case that the bulk modulus decreases toward the outside on both sides, i.e., in the medial and lateral direction, from the instability region. This will still be discussed in detail below.

In an embodiment of the present invention, provision is made, in the region of the gait line, for the sole to have an instability region which follows the contour of the gait line, at least in sections extends in the longitudinal direction of the sole and has an increased sole thickness compared to the adjacent medial and/or lateral regions of the sole such that the result of this is an uneven sole contour perpendicular to the running direction. In this embodiment, instability is achieved by a geometric change of the outer sole, with the shape of the sole deviating from the conventionally-provided planar and flat sole shape. Provision can, for example, be made for a sole contour which is convexly rounded or curved perpendicular to the running direction. By way of example, starting from the gait line, the sole thickness can reduce continuously or non-continuously toward the outside such that the result of this is a correspondingly rounded, ball-like, curved or else angled sole shape perpendicular to the running direction on the running side of the sole. It is also the case in the alternative embodiment of the present invention that an instability is created underfoot during walking, running and physical exercise, with the above-described effects.

It is understood that, in the region of the instability region, the sole can have an increased bulk modulus compared to the adjacent medial and/or lateral regions of the sole and, at the same time, have an increased sole thickness in order to create a wanted instability underfoot when striking the ground.

In an embodiment of the present invention, the instability region can, for example, extend continuously over at least the metatarsal region and the forefoot region to the front end of the sole edge. In principle, it is also possible and advantageous for the instability region to extend along the gait line over the whole length of the sole, i.e., from a rear end of the sole edge via the heel, metatarsal and forefoot regions up to a front end of the sole edge. However, optionally, it is also possible for the instability region to extend in the direction of the gait line only in sections, with it being possible for sole sections with increased bulk modulus and/or increased sole thickness and sections with lower bulk modulus and/or lower sole thickness to be provided following one another in the longitudinal direction of the sole.

The width of the instability region can be approximately 10% to 70%, for example, approximately 20% to 50%, for example, approximately 30% to 40%, of the heel width at 20% to 30%, for example, at approximately 25%, of the sole length. The instability region then extends in a band-like fashion along the gait line, wherein the instability region can, for example, have an unchanging width in the longitudinal direction. However, in principle, it is also possible for the width of the instability region to change in the longitudinal direction within the aforementioned limits. The instability region can run symmetrically on both sides of the gait line, wherein the central longitudinal axis of the region with increased bulk modulus and/or of the region with increased sole thickness can substantially coincide with the gait line. This contributes to creating an increased instability underfoot when striking the ground without having an adverse effect on the comfort of wear. A shoe with the sole according to the present invention is therefore perceived to be very comfortable to wear.

In order to create an ever greater instability underfoot when striking the ground, the instability region, in the medial and/or lateral direction, can have at least two regions with a differently high bulk modulus and/or a different sole thickness. In this context, provision can, for example, be made for the bulk modulus and/or the sole thickness in the region of the instability region to decrease, for example, continuously or else discontinuously, toward the outside from the gait line in the medial and/or lateral direction. The points on the sole with the greatest bulk modulus and/or the greatest sole thickness form a line which substantially coincides with the gait line. Naturally, it is also possible, in principle, for the bulk modulus and/or the sole thickness to be constant over the width and, for example, over the length of the instability region. In the outer regions outside of the instability region, the value of the bulk modulus and/or the value of the sole thickness can decrease to approximately 80%, for example, approximately 60%, in particular approximately 40%, more particularly approximately 20% or less of the value of the bulk modulus and/or of the sole thickness in the instability region. It is also possible for the bulk modulus and/or the sole thickness to decrease further toward the outside in the outer region, i.e., adjacent to the side of the instability region in the medial or lateral direction. As a result, it is possible to predetermine a constant decrease in the bulk modulus and/or in the sole thickness perpendicular to the running direction, starting from the instability region, which leads to a high comfort of wear while at the same time contributing to great instability when striking the ground.

The value of the bulk modulus and/or the value of the sole thickness in the instability region and/or outside of the instability region can decrease continuously and, for example, with an unchanging gradient or an unchanging curvature toward the outside in the medial and/or lateral direction. A non-continuous change in the bulk modulus and/or in the sole thickness is also feasible over the width of the sole.

The present invention will hereafter be explained in more detail below on the basis of the drawing, without the present invention being restricted to the illustrated embodiment.

FIG. 1 schematically illustrates the profile of the gait line for the sole 1 of a shoe. In the case of walking and running, the foot strikes the ground at the outermost (lateral) edge of the heel. During the heel-toe walking with the foot after striking the ground, the gait line initially wanders under the center of the heel (line TG1) up to T25 at 25% of the shoe-sole length. Between 25% (T25) and 65% (T65) of the shoe-sole length, the center of pressure line (gait line) moves in a straight line (line TG2) below the medial region of the os cuboideum (cuboid bone) and between the third and fourth metatarsal bones (metatarsus) up to the posterior portion of the metatarsal heads. Between 65% (T65) and 70% (T70) of the shoe-sole length (region of the metatarsal heads or metatarsus heads), the gait line (line TG3) curves strongly in the medial direction along the metatarsal heads. The gait line initially continues to move in the medial direction with average curvature toward the large toe between 70% (T70) and the last contact point E (line TG4). In the last section of contact with the ground (15% of the sole length), the gait line moves with very little curvature in the direction of the first ray of the foot to the front sole periphery or to the last contact point E.

A mathematical description of the gait line can be brought about as follows:

1. Determine the center point F at the rear end of the sole edge of the heel.
2. Determine the center point V at the front end of the sole edge of the forefoot region.
3. Determine the sole length L by drawing a straight line between F and V.
4. Establish the segment T25 by a line perpendicular to the sole-length axis at 25% of the sole length L, starting from the heel center point F. The intersections of the line T25 with the inner and outer outline of the sole define the medial point M1 and the lateral point L1 and hence the length of the segment M1L1.
5. Determine B as center point of T25 (50% of the segment M1L1).
6. A ray is plotted from the intersection of the center line FV with the segment T25 at an angle of 20° to the rear lateral sole outer edge. The intersection with the outline defines the point A of striking the ground.
7. Establish the partial gait line TG1 as a connection between points A and B by the following mirrored parabolic function, which has been rotated by 240°:

$$Y=0.30\cdot X^2$$

In this function, the X-value (in cm) increases to 16% of the sole length L and has its origin at point A.

8. Establish the segment T65 by a line perpendicular to the sole-length axis at 65% of the sole length L, starting from the heel center point F. The intersections of the line T65 with the inner and outer outline of the sole define the medial point M2 and the lateral point L2 and hence the length of the segment M2L2.
9. Define point C at the distance of 56% of the length of M2L2 on the segment T65, starting from M2.
10. Establish the central partial gait line TG2 as a straight line between points B and C.
11. Establish the segment T70 by a line perpendicular to the sole-length axis at 70% of the sole length L, starting from the heel center point F. The intersections of the line T70 with the inner and outer outline of the sole define the medial point M3 and the lateral point L3 and hence the length of the segment M3L3.
12. Define point D at the distance of 55% of the length of M3L3 on the segment T70, starting from M3.
13. Establish the partial gait line TG3 as a connection between points C and D by the following parabolic function, which has been rotated by 345°:

$$Y=0.80\cdot X^2$$

In this function, the X-value (in cm) increases to 2.7% of the sole length L and has its origin at point C.

14. Establish the partial gait line TG4 as a connection between points D and E by the following mirrored parabolic function, which has been rotated by 245°:

$$Y=0.26\cdot X^2$$

In this function, the X-value (in cm) increases to 20% of the sole length L and has its origin at point D. Point E is defined by the intersection of the mirrored parabola with the inner sole outline of the forefoot region.

Figure 2:
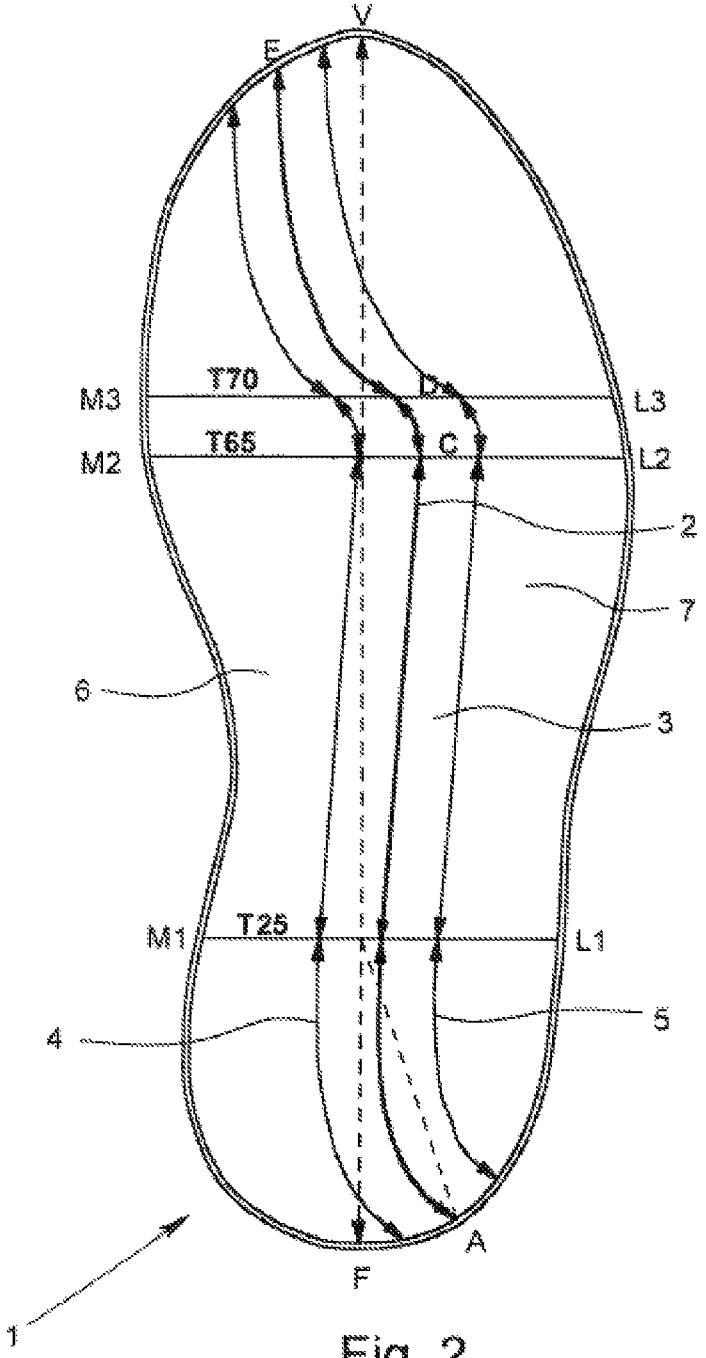
FIG. 2 shows the shoe sole illustrated in FIG. 1, with the profile of an instability region with an increased bulk modulus and/or an increased sole thickness compared to the adjacent medial and/or lateral regions of the sole being plotted.

FIG. 2 illustrates an instability region 3 which substantially follows the contour of the gait line 2 and at least in sections extends over the sole 1 in the direction of the gait line 2, which instability region is delimited by a medial boundary line 4 in the medial direction and by a lateral boundary line 5 in the lateral direction. Toward the outside, a medial outer region 6 and a lateral outer region 7 adjoin the instability region 3.

In order to reduce the stability when striking the ground in the case of the normal gait, the sporty running or sprinting, the instability region 3 has an increased bulk modulus and optionally an increased sole thickness compared to the adjacent medial and lateral outer regions 6, 7. As a result, the balancing ability is trained when striking the ground, the muscle coordination is schooled and the muscles are strengthened. The instability region 3 extends from point A to point E over the whole length of the gait line, with the width of the instability region 3 being approximately 30% of the heel width at 25% of the shoe-sole length (at the point T25). Starting from the point A where the foot strikes the ground, the instability region 3 has a substantially unchanging width up to point C. In the transition region from point C to point D, the width of the instability region 3 then reduces such that the result of this is the profile of the medial boundary line 4 and the lateral boundary line 5 as sketched in FIG. 2. The center line through the instability region 3 in this case coincides with the gait line 2, and so the boundary lines 4, 5 run symmetrically on both sides of the gait line 2.

In the region of the instability region, the bulk modulus of the sole 1 and optionally the sole thickness decrease toward the outside from the gait line 2 in the direction of the medial boundary line 4 and the lateral boundary line 5. In the outer regions 6, 7, the bulk modulus and optionally the sole thickness decrease further toward the outside in the medial and/or lateral direction such that the bulk modulus and optionally the sole thickness can assume the greatest values in the region of the gait line. In the medial outer region 6 and in the lateral outer region 7, the bulk modulus of the sole 1 and/or the sole thickness can decrease to a value of approximately 80% to 20% of the bulk modulus or the sole thickness in the instability region 3.

Starting from the gait line, the decrease in this case is brought about toward the outside in the medial and lateral direction, for example, with an unchanging gradient or (in respect of the sole thickness), for example, with an unchanging curvature.

FIGS. 3*a* to 3*d* schematically illustrate possible sole profiles, which relate to the section I-I from FIG. 1. On the running side, the sole 1 has an uneven sole contour perpendicular to the running direction. Here, according to FIG. 3*a*, a convexly rounded or curved sole contour is provided perpendicular to the running direction. The position of the instability region 3 and the adjoining outer regions 6, 7 is illustrated schematically in each case. According to FIG. 3*a*, the point with the maximum sole thickness P lies in the region of the central longitudinal axis of the sole 1. The point with the maximum bulk modulus can also be provided here.

Figure 3:
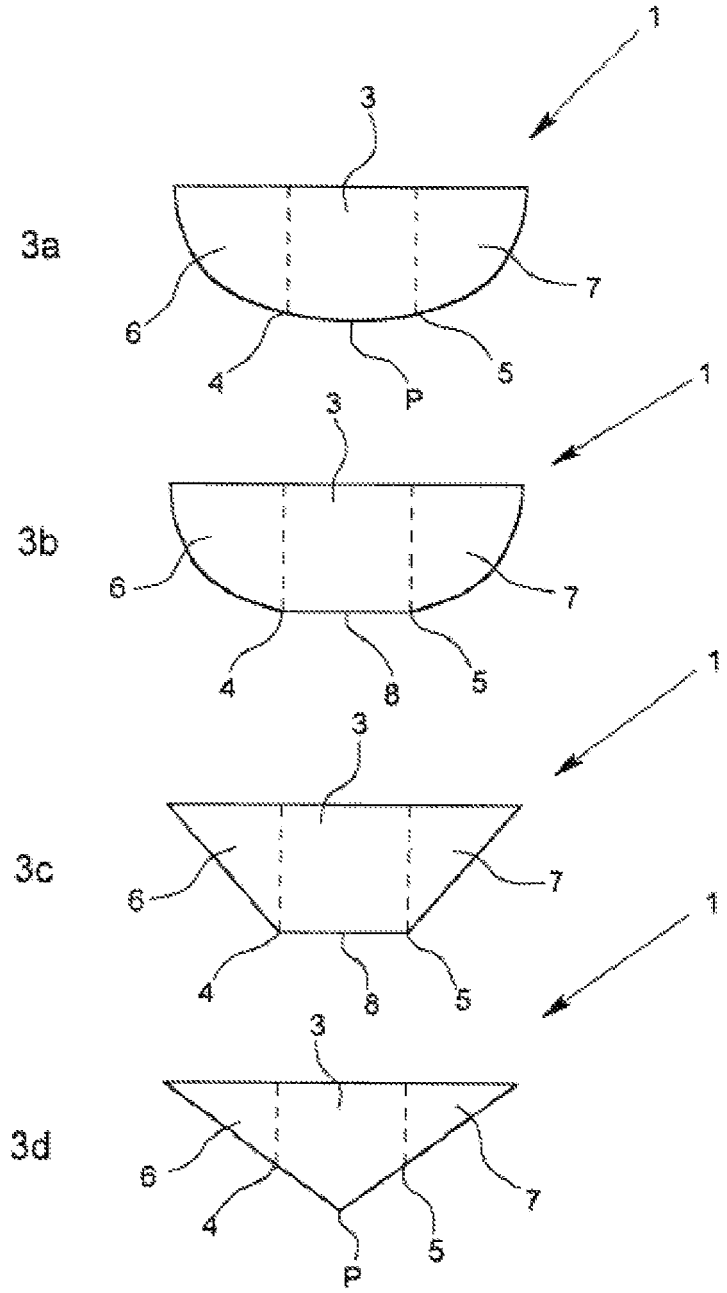
FIGS. 3*a*-3*d* show schematic sectional views along the line I-I in FIG. 1 for different cross-sectional contours of a shoe sole according to the present invention.

FIGS. 3*b*, 3*c* and 3*d* show possible alternative embodiments of a sole 1 with a sole contour that is uneven perpendicular to the running direction. According to FIG. 3*b*, on the running side, the sole 1 has an even region 8 where the foot strikes the ground in the region of the instability region 3. Starting from the medial boundary line 4 and the lateral boundary line 5, the sole thickness then decreases toward the outside and follows an arc-shaped profile. According to FIG. 3*c*, provision is made for the sole thickness to decrease toward the outside along a straight line, starting from the boundary lines 4, 5. In the embodiment illustrated in FIG. 3*d*, the sole 1 has a substantially triangular cross-sectional profile with, in turn, the point P with maximum sole thickness running in the region of the central longitudinal axis of the sole 1. The aforementioned profiles can correspondingly apply to the bulk modulus.

It is understood that the present invention also comprises those embodiments as equivalent embodiments in which the gait line deviates by ±10% to 25%, more particularly, by ±15% to 20%, from the mathematically described and illustrated profile of the gait line 2.

The present invention is not limited to embodiments described herein; reference should be had to the appended claims.

What is claimed is:

1. A sole for a shoe designed to increase an instability upon striking the ground, the sole extending from a rear heel region via a metatarsal region to a front forefoot region, wherein, in a region of a gait line, the sole comprises:

an instability region which follows a contour of the gait line and extends along the gait line along an entire length of the sole in a longitudinal direction of the sole so as to reduce a stability of the shoe when the shoe strikes the ground in a normal gait; and at least one of:

a bulk modulus which is increased compared to a medial outer region and a lateral outer region of the sole adjacent to the instability region, and a sole thickness which is increased compared to the medial outer region and the lateral outer region of the sole adjacent to the instability region so as to provide an uneven sole contour perpendicular to a running direction.

2. The sole as recited in claim 1, further comprising a sole contour, wherein the sole contour is convexly rounded or curved perpendicular to the running direction.

3. The sole as recited in claim 1, further comprising a front end of a sole edge, wherein the instability region extends continuously over at least the metatarsal region and the front forefoot region to the front end of the sole edge.

4. The sole as recited in claim 1, wherein the instability region has a width, and further comprising a heel width and a sole length, wherein the width of the instability region is about 10% to 70% of the heel width at about 20% to 30% of the sole length.

5. The sole as recited in claim 4, wherein the width of the instability region is about 20% to 50% of the heel width at about 20% to 30% of the sole length.

6. The sole as recited in claim 4, wherein the width of the instability region is about 30% to 40% of the heel width at about 25% of the sole length.

7. The sole as recited in claim 1, wherein the width of the instability region does not change in a direction of the gait line.

8. The sole as recited in claim 1, wherein the instability region runs symmetrically on each side of the gait line.

9. The sole as recited in claim 1, wherein the instability region, in at least one of the medial direction and the lateral direction, further comprises at least two regions having at least one of a different bulk modulus and a different sole thickness.

10. The sole as recited in claim 1, wherein at least one of the bulk modulus and the sole thickness in at least one of the medial outer region and in the lateral outer region is less than about 80% of at least one of the bulk modulus and the sole thickness in the instability region.

11. The sole as recited in claim 10, wherein at least one of the bulk modulus and the sole thickness in at least one of the medial outer region and in the lateral outer region is less than about 60% of at least one of the bulk modulus and the sole thickness in the instability region.

12. The sole as recited in claim 10, wherein at least one of the bulk modulus and the sole thickness in at least one of the medial outer region and in the lateral outer region is less than about 40% of at least one of the bulk modulus and the sole thickness in the instability region.

13. The sole as recited in claim 10, wherein at least one of the bulk modulus and the sole thickness in at least one of the medial outer region and in the lateral outer region is less than about 20% of at least one of the bulk modulus and the sole thickness in the instability region.

14. The sole as recited in claim 1, wherein at least one of the bulk modulus and the sole thickness in at least one of the medial outer region and in the lateral outer region decreases toward an outside in at least one of a medial direction and a lateral direction.

15. The sole as recited in claim 1, wherein at least one of the bulk modulus and the sole thickness in at least one of the instability region, the medial outer region and the lateral outer region decreases continuously toward an outside in at least one of a medial direction and a lateral direction.

16. The sole as recited in claim 15, wherein at least one of the bulk modulus and the sole thickness in at least one of the instability region, the medial outer region and the lateral outer region decreases with an unchanging gradient or with an unchanging curvature toward the outside in at least one of the medial direction and the lateral direction.

17. A shoe for schooling coordination and for strengthening muscles comprising the sole as recited in claim 1.

* * * * *